US008368543B2

(12) United States Patent
Yang

(10) Patent No.: US 8,368,543 B2
(45) Date of Patent: Feb. 5, 2013

(54) EAS TAG WITH WRAPPING TETHERS AND COVER

(76) Inventor: Xiao Hui Yang, Los Altos, CA (US)

( * ) Notice: Subject to any disclaimer, the term of this patent is extended or adjusted under 35 U.S.C. 154(b) by 51 days.

(21) Appl. No.: 13/151,106

(22) Filed: Jun. 1, 2011

(65) Prior Publication Data

US 2011/0227706 A1 Sep. 22, 2011

Related U.S. Application Data

(63) Continuation-in-part of application No. 12/815,380, filed on Jun. 14, 2010, now Pat. No. 8,334,776, and a continuation-in-part of application No. 13/010,571, filed on Jan. 20, 2011, which is a continuation-in-part of application No. 12/726,879, filed on Mar. 18, (Continued)

(51) Int. Cl.
*G08B 13/14* (2006.01)

(52) U.S. Cl. ..... 340/572.8; 340/572.1; 340/10.1

(58) Field of Classification Search ..... 340/505, 340/572.1, 10.1

See application file for complete search history.

(56) References Cited

U.S. PATENT DOCUMENTS

| | | | | |
|---|---|---|---|---|
| 4,086,795 | A | 5/1978 | Foster | |
| 4,620,182 | A | 10/1986 | Keifer | |
| 4,756,171 | A | 7/1988 | Homar | |
| 4,776,188 | A | 10/1988 | Dalaba | |
| 4,893,853 | A | 1/1990 | Guiler | |
| 4,896,517 | A | 1/1990 | Ling | |
| 4,962,369 | A | 10/1990 | Close | |
| 5,156,028 | A | 10/1992 | Jiang | |
| 5,337,459 | A | 8/1994 | Hogan | |
| 5,565,848 | A | 10/1996 | Leyden | |
| 5,570,080 | A | 10/1996 | Inoue | |
| 5,722,266 | A | 3/1998 | Yeager | |
| 5,764,147 | A | 6/1998 | Sasagawa | |
| 5,767,773 | A | 6/1998 | Fujiuchi | |
| 5,786,759 | A | 7/1998 | Ling | |
| 5,794,464 | A | 8/1998 | Yeager | |
| 5,856,782 | A | 1/1999 | Sasagawa | |
| 5,959,532 | A | 9/1999 | Fujiuchi | |
| 6,020,819 | A | 2/2000 | Fujiuchi | |
| 6,092,401 | A | 7/2000 | Sankey | |
| 6,140,923 | A | 10/2000 | Lam | |
| 6,177,869 | B1 | 1/2001 | McDaid | |
| 6,237,375 | B1 * | 5/2001 | Wymer | 70/14 |
| 6,420,971 | B1 | 7/2002 | Leck | |
| 6,550,293 | B1 | 4/2003 | Delegato | |
| 6,624,753 | B2 | 9/2003 | Elston | |
| 6,731,212 | B2 | 5/2004 | Hirose | |
| 6,755,055 | B2 | 6/2004 | Sedon | |

(Continued)

*Primary Examiner* — Travis Hunnings

(74) *Attorney, Agent, or Firm* — Waters Law Group, PLLC; Robert R. Waters; Brian W. Foxworthy

(57) ABSTRACT

An electronic article surveillance (EAS) system is comprised of a first EAS housing and a second EAS housing, each having electrically conducting tethers and a cover to hold the housing in place on an object to be protected. The covers have a surface with adhesive on it. Each housing is placed in a cover with the tethers extending through the cover, and the adhesive surface is pressed to the object. Switches on the bottom of the housing indicate contact with an object. The housings have apertures for receiving the ends of the tethers which are extended from the housings and inserted into the apertures of the other housing to complete circuits between the housings. Electronics within the housings monitor the circuits and switches for tampering and can generate alarms. External devices may arm and disarm the housings via wireless communication. A magnet releases a blocking mechanism to remove the housings.

23 Claims, 6 Drawing Sheets

Related U.S. Application Data

2010, now Pat. No. 8,305,219, which is a continuation-in-part of application No. 12/498,367, filed on Jul. 7, 2009, now Pat. No. 8,274,391, which is a continuation-in-part of application No. 12/391,222, filed on Feb. 23, 2009, now Pat. No. 8,144,014.

(60) Provisional application No. 61/186,889, filed on Jun. 14, 2009, provisional application No. 61/030,932, filed on Feb. 22, 2008, provisional application No. 61/030,929, filed on Feb. 22, 2008.

(56) References Cited

U.S. PATENT DOCUMENTS

| | | | | |
|---|---|---|---|---|
| 7,162,899 | B2 | 1/2007 | Fawcett | |
| 7,168,275 | B2 | 1/2007 | Fawcett | |
| 7,227,467 | B2 | 6/2007 | Feibelman | |
| 7,239,238 | B2 | 7/2007 | Tester | |
| 7,251,966 | B2 | 8/2007 | Fawcett | |
| 7,350,381 | B2 | 4/2008 | Fawcett | |
| 7,400,254 | B2 * | 7/2008 | Yang et al. | 340/572.1 |
| 7,403,118 | B2 | 7/2008 | Belden, Jr. | |
| 7,474,209 | B2 | 1/2009 | Marsilio | |
| 7,474,222 | B2 * | 1/2009 | Yang et al. | 340/572.8 |
| 7,481,086 | B2 | 1/2009 | Fawcett | |
| 7,497,100 | B2 | 3/2009 | Fawcett | |
| 7,497,101 | B2 * | 3/2009 | Fawcett et al. | 70/57 |
| 7,522,048 | B2 | 4/2009 | Belden, Jr. | |
| D599,693 | S | 9/2009 | Sayegh | |
| 7,659,817 | B2 | 2/2010 | Conti | |
| 7,685,850 | B2 | 3/2010 | Nilsson | |
| D628,923 | S | 12/2010 | Sayegh | |
| D628,924 | S | 12/2010 | Sayegh | |
| 7,918,112 | B2 | 4/2011 | Fawcett | |
| 8,144,014 | B1 * | 3/2012 | Yang | 340/572.1 |
| 2006/0220848 | A1 | 10/2006 | Tropper | |
| 2006/0250241 | A1 * | 11/2006 | Renzetti et al. | 340/572.1 |
| 2009/0212920 | A1 | 8/2009 | Yang | |
| 2009/0289798 | A1 * | 11/2009 | Yang | 340/572.8 |
| 2010/0171621 | A1 * | 7/2010 | Yang | 340/572.9 |
| 2010/0188227 | A1 | 7/2010 | Yang | |
| 2010/0214102 | A1 * | 8/2010 | Yang | 340/572.9 |
| 2010/0315237 | A1 | 12/2010 | Yang | |
| 2010/0315239 | A1 * | 12/2010 | Yang | 340/572.9 |
| 2011/0115632 | A1 * | 5/2011 | Yang | 340/572.8 |
| 2011/0121973 | A1 * | 5/2011 | Yang | 340/572.8 |
| 2011/0260594 | A1 * | 10/2011 | Yang | 312/297 |

* cited by examiner

EAS TAG WITH WRAPPING TETHERS AND COVER

CROSS REFERENCE TO RELATED APPLICATIONS

This application is a continuation-in-part of U.S. patent application Ser. No. 12/815,380 filed on Jun. 14, 2010, now U.S. Pat. No. 8,334,776 and U.S. patent application Ser. No. 13/010,571 filed on Jan. 20, 2011. U.S. patent application Ser. No. 12/815,380 in turn claims priority to U.S. Provisional Application 61/186,889 filed on Jun. 14, 2009. U.S. patent application Ser. No. 13/010,571 is a continuation-in-part application based on U.S. patent application Ser. No. 12/726,879 filed on Mar. 18, 2010, which is now U.S. Pat. No. 8,305,219. U.S. patent application Ser. No. 12/726,879 is a continuation-in-part application based on U.S. patent application Ser. No. 12/498,367, filed on Jul. 7, 2009, now U.S. Pat. No. 8,274,391. U.S. patent application Ser. No. 12/498,367 is a continuation-in-part application based on U.S. patent application Ser. No. 12/391,222 filed on Feb. 23, 2009 now U.S. Pat. No. 8,144,014 in turn claiming priority to U.S. Provisional Application 61/030,932, filed on Feb. 22, 2008, and U.S. Provisional Application 61/030,929 filed on Feb. 22, 2008. The entire disclosures contained in U.S. patent application Ser. Nos. 12/815,380, 13/010,571, 12/726,879, 12/498,367, U.S. Pat. No. 8,334,776, U.S. Pat. No. 8,305,219, U.S. Pat. No. 8,274,391, U.S. Pat. No. 8,144,014 and 12/391,222, U.S. Provisional Applications 61/186,889, 61/030,932, and 61/030,929, including the attachments thereto, are incorporated herein by reference.

FIELD OF THE INVENTION

This application relates to the field of electronic article surveillance (EAS) and security. In particular, this application relates to EAS systems that wrap elements around an object to be protected and monitor the elements with electronics in associated housings.

BACKGROUND OF THE INVENTION

Electronic article surveillance systems have been used for many years as a means of deterring retail shoplifting in clothing stores, electronic stores, and a myriad of other retail establishments. Generally speaking, an EAS system will begin with a tag, consisting of a durable and reliable, yet small, sensor tag which is affixed to the article to be detected in such a way that it cannot be easily removed by a customer in the store. Usually, the system depends upon the feature that the attachment mechanism is constructed such that it can only be removed by the use of a specialized tool which is only in the possession of the store personnel at the checkout register or exit port for the establishment. In the event that an EAS tag is not removed from a protected article prior to exiting the store, an alarm or other signal is activated.

In many commercially available EAS systems, one or more antennas are placed at the exits and entrances to the retail location. These antennas set up zones, sometimes referred to as interrogation zones, in which an EAS tag (or marker) may be sensed. At least one antenna serves the function of sending out what is called an interrogation signal. The markers on the merchandise are affected by this signal and will respond with a signal of their own. Either the same antenna that sends out the interrogation signal or other additional antennas can sense the signals from the markers. The most effective way to do this is by stopping the broadcast of the interrogation signal to listen for the signals emanating from the markers. If a marker is sensed within the zone created by the antennas, it is presumed that an article is being removed without purchase, and alarms are set off. These alarms may be audible alarms for general broadcast or the alarms may be silent alarms in the form of a light at a check-out counter or security station, etc.

In the earliest EAS systems passive EAS elements were used in the EAS tags. In systems using passive elements, an interrogation field is created at control locations, such as exits, by transmitting antennas. The transmitting antennas intermittently create a field in their near surroundings. This field and the passive EAS element are tuned to each other. If an EAS tag having a passive element enters an interrogation field, the field energizes the passive element which allows the passive element to produce a signal. The passive element may be of a type that produces a signal that is a harmonic of the interrogation field or a signal that resonates with the interrogation field.

More recently developed EAS systems employ wireless communication with the EAS tags. The electronics onboard the EAS tags are more sophisticated. Some systems may employ radio frequency communication as the wireless communication, while others may employ optical communication, such as infrared communication. Some may employ both radio frequency and optical communication. Also, EAS systems employing wireless communication may also employ passive elements in the tags as well.

In order to make an EAS system effective, one must consider how to make the EAS tags tamper resistant. This is an on-going effort, because over time, thieves become more clever in learning how to tamper with an EAS tag such as to defeat it. The retailer (and the tag manufacturer) must consider how to detect and prevent tampering with the tags. The particular construction of a tag will determine how tampering is detected.

RELATED ART

U.S. Pat. No. 7,474,209 by Marsilio et. al is for a "Cable Alarm Security Device." A security device for attachment to an article to deter theft of the article has a housing containing an alarm system including an audible alarm and an LED. A cable has one end attached to the housing and a second end attached to a plug which is selectively inserted into and locked to the housing. The cable includes a conductor electrically connected to the alarm system when in the locked position. The audible alarm is activated if the integrity of the cable is compromised. An EAS tag located in the housing will actuate an alarm at a security gate and can actuate the audible alarm of the security device when the device is in proximity to a security gate. The LED is positioned in the housing to be visible from both sides of the housing. A magnetically attractable lock mechanism releasably secures the cable plug in the locked position.

U.S. Pat. No. 5,722,266 by Yeager et al. is for a "Universal Wrap Security Device." A security device includes a locking member, a ratchet member, and a plurality of cables. The cables extend through both a fastener and a base of the locking member and are wrapped around all six sides of a book or box-like structure. The fastener is releasably snap-fitted into the base and secured therein by a pair of metal tines. The ratchet member includes a housing containing a gear and bearing member which are latched together in a spaced relationship to form a reel and a pawl. A bottom plate encloses the contents of the housing. The gear includes a multi-sided key hole, a plurality of openings to secure enlarged ends of the cables therein, and a plurality of teeth. The gear and bearing member each include an annular nub which sits in and rotates around a corresponding bearing surface of the bottom plate and housing, respectively. The pawl has a catch and a resilient spring and communicates with the gear to allow the ratchet member to be turned only in one direction. Two specialized tools are required to tighten the device around the box-like structure and to remove the security device from the same.

U.S. Pat. No. 7,162,899 by Fawcett et al. is for a "Cable Wrap Security Device." A security device includes a locking member, a ratchet mechanism, and a plurality of cables. The cables extend through both a fastener and a base of the locking member and are wrapped around all six sides of a box-like structure. The fastener is releasably snap-fitted into the base of the locking member and secured therein by a magnetically attractable tine. The ratchet mechanism includes a housing containing a spool and a locking pawl. A bottom wall encloses a portion of the housing and includes a rotatable central portion having a key receiving recess for unlocking the spool from the pawl. The housing has a rotatable top wall portion which includes a flip-up handle for rotating the top wall portion and the internal ratchet to tighten the cable about an article. An alarm system is contained in the housing of the ratchet mechanism and actuates an audible alarm upon certain unauthorized actions occurring. An LED located within the housing provides a visual indication that the alarm system is activated.

U.S. Pat. No. 7,685,850 by Nilsson is for a "Security Wrapper." A security device comprises a retaining member forming an adjustable loop, including a cable; a ratchet member connected to the cable, operable to narrow the loop and to prevent widening of the loop, including a first main part comprising a gear ring extending in a first plane with a saw tooth profile raised from the plane, a second main part, rotatable relative to the first main part, including a latch member biased towards the first plane to engage the gear ring, and a drum for winding up of the cable.

SUMMARY

An electronic article surveillance (EAS) system is comprised of a first EAS housing and a second EAS housing, each having tethers and a cover to hold the EAS housing in place on an object to be protected. Excess length of tether may be withdrawn into the housing such as on spring biased reels within the housings. The covers have a surface such as a flange with adhesive on it. The adhesive may be placed on the cover by the end user or when the cover is manufactured. Each EAS housing is placed in a cover with the tethers extending through the cover, and the adhesive surface is pressed to the object. Switches on the bottom of the housing indicate contact with an object.

The EAS housings have apertures for receiving the ends of the tethers and the covers have apertures allowing access to the apertures in the housings. The housings are placed on different surfaces of the object to be protected and are oriented at a 90° angle with respect to each other so that the tethers are somewhat directed toward the apertures. After the housings are attached to an object, the tethers are pulled from the housings and inserted into the apertures of the other housing to wrap the object to be protected in the tethers. In some embodiments the tethers can conduct electricity and create circuits between the housings when connected to the housings.

Electronic packages within at least one of the housings monitor the circuits and switches for tampering and can generate alarms. The electronic packages may include, among other elements, a circuit board, a microprocessor, a sound generator, a light emitting diode, plunger switch, power switch, a power supply, and wireless communication elements such as an optical communication port or radio frequency circuits. The microprocessor has machine readable instructions which provide the logic for analyzing inputs such as completed circuits and changed switches to determine alarm conditions and to respond. External devices may arm and disarm the housings via wireless communication as well as exchange information with the housings and reprogram the microprocessor.

In some embodiments, a retention mechanism in the housing, such as a slide, may move to engage and retain the end of a tether when the tether end is inserted into the housing. A blocking mechanism may prevent reversal of the retention mechanism by unauthorized persons. In some embodiments, after the housing is disarmed, a magnet may shift the blocking mechanism to allow removal of the tethers and subsequent removal of the housings without generating alarms. For embodiments employing electrically conductive tethers, the retention mechanism may supply electrical continuity with the electronic packages within the housings or between the tethers. In other embodiments, other elements, such as fixed contacts within the housings, may supply the electrical continuity between the electrically conductive tethers and the electronic packages or between the tethers with each other.

BRIEF DESCRIPTIONS OF THE DRAWINGS

DESCRIPTION OF THE EMBODIMENTS

Figure 2:
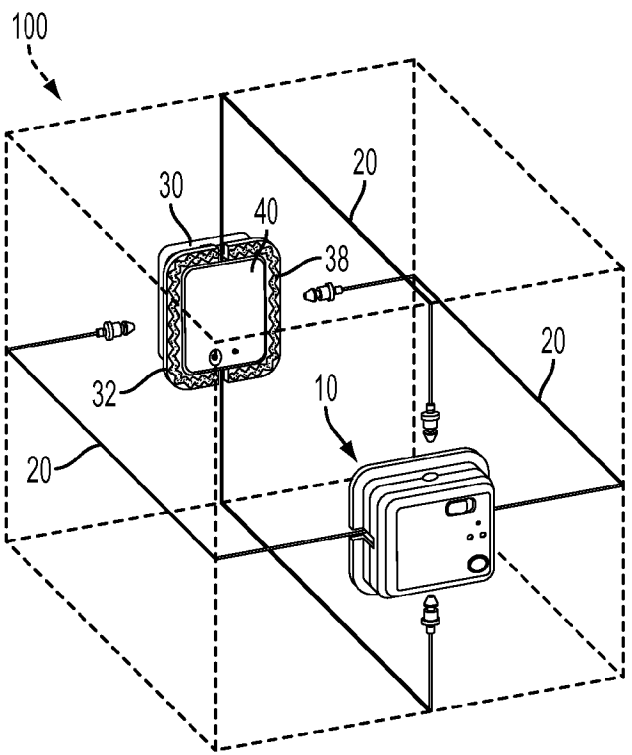
FIG. 2 shows a set of an embodiment of EAS tags with wrapping tethers and cover installed on a box as an item to be monitored or protected with the box in dotted lines to show the second EAS tag on the opposite side of the box.
Figure 1:
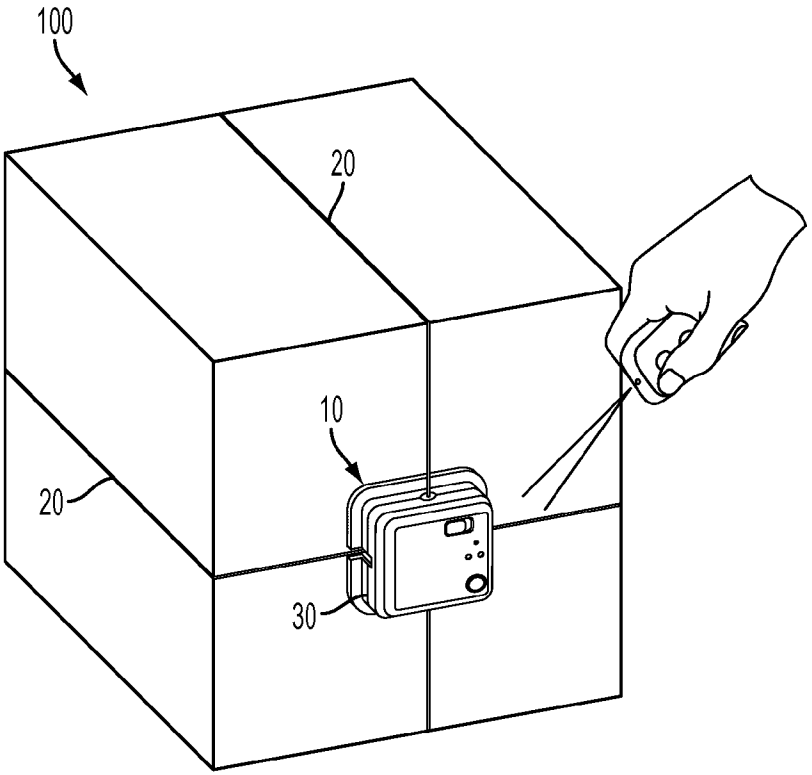
FIG. 1 shows a set of an embodiment of EAS tags with wrapping tethers and cover installed on a box as an item to be monitored or protected.

FIG. 1 shows a set of an embodiment of EAS tags 10 with wrapping tethers 20 and cover 30 installed on a box 100 as an item to be monitored or protected. In the embodiment shown in FIG. 1, cover 30 is at least partially transparent, or translucent, and housing 40 may be seen within it. FIG. 2 shows a set of an embodiment of EAS tags 10 with wrapping tethers 20 and cover 30 installed on a box 100 as an item to be monitored or protected, with box 100 in dotted lines to show the second EAS tag 10 on the opposite side of box 100. As with FIG. 1, cover 30 is at least partially transparent, or translucent.

In FIG. 2, it may be seen that each EAS tag 10 has two tethers 20 extended from its central housing 40. In FIG. 2, tethers 20 of each EAS tag 10 are not joined to the complementary EAS tag 10, but rather are shown extended around box 100 with their ends 21 close to the complementary EAS tag 10. This shows that each EAS tag 10 has two tethers 20 extending from housings 40 and that housings 40 and covers 30 each have two insert apertures 41 and 31, respectively, and that the EAS tags 10 are oriented orthogonally to each other. That is to say, EAS tag 10 on the near side of box 100 is oriented to have its tethers 20 running horizontally around the four sides of box 100, while the EAS tag 10 on the far side of box 100 is oriented to have its tethers 20 running vertically on the sides where the two EAS tags 10 are mounted and horizontally on the top and bottom of box 100. In the embodiment shown in FIG. 2, tethers 20 have plugs 22 at their ends 21.

In FIGS. 1 and 2, flange 31 of cover 30 can be seen around cover 30. In FIG. 2, the underside of flange 32 as well as the underside of housing 40 may be seen. In at least one embodiment, flange 32 has adhesive 38 on its underside which serves to maintain EAS tag 10 in position on an object to be protected, or monitored, such as box 100. This adhesive may be added by the end user of EAS tag 10 when the cover is applied to object 100, or it may be applied at an earlier point in time, such as when cover 30 is manufactured or packaged for use.

Figure 3:
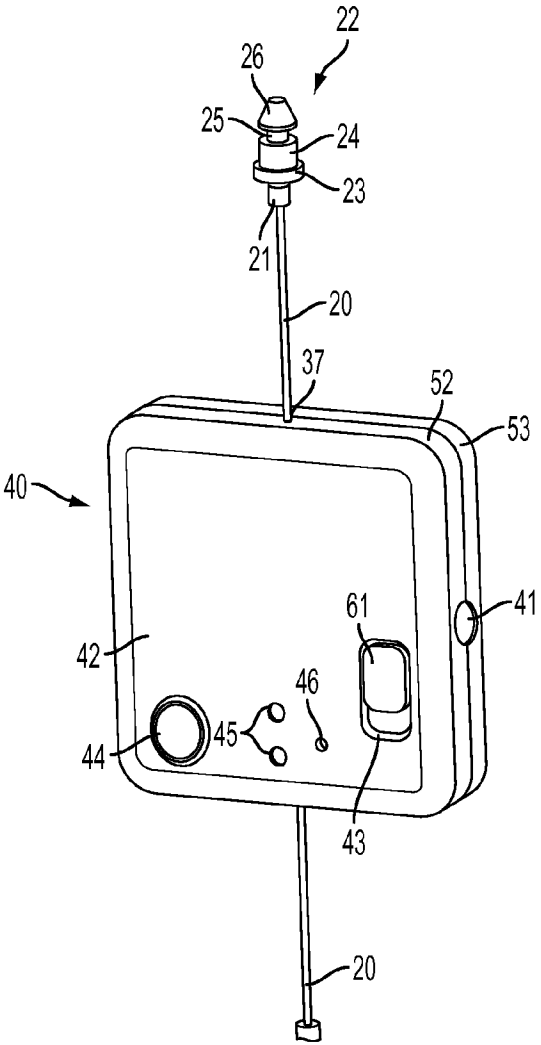
FIG. 3 is a top perspective view of the housing and tethers of an embodiment of an EAS tag with wrapping tethers and cover.

FIG. 3 is a top perspective view of housing 40 and tethers 20 of an embodiment of an EAS tag 10 with wrapping tethers 20 and cover 30. On top surface 42 several features of housing 40 may be seen. Slide button 61 protrudes through slide aperture 43 in top surface 42. Release dome 44 in top surface 42 marks where a magnet may be applied to allow slide button 61 to be slid to release tethers 20. Optical apertures 45 allow optical communications with an electronics package within housing 40. Optical apertures 45 may have a translucent or transparent covering. Auditory aperture 46 in top surface 42 provides an unobstructed exit for auditory signals generated by an electronics package within housing 40. Along the sides of housing 40 are located two insert apertures 41 and two tether apertures 47 (only one of each is visible in FIG. 3). The two insert apertures 41 are located on opposite sides from each other, and the two tether apertures 47 are located on opposite sides from each other. Tether 20 extends out of tether aperture 47. Insert aperture 41 receives the end 21 of a tether from another EAS tag with wrapping tethers and cover 10.

Figure 4:
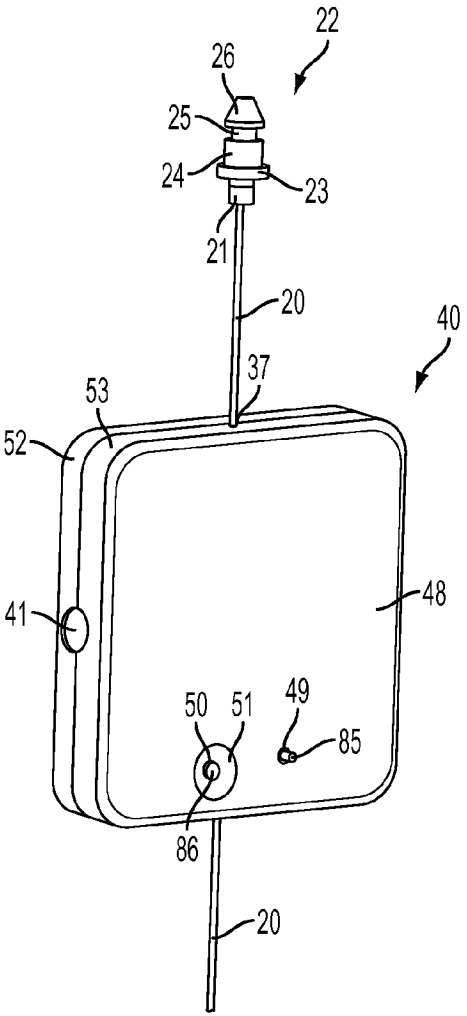
FIG. 4 is a bottom perspective view of the housing and tethers of an embodiment of an EAS tag with wrapping tethers and cover.

FIG. 4 is a bottom perspective view of housing 40 and tethers 20 of an embodiment of an EAS tag 10 with wrapping tethers 20 and cover 30. On bottom surface 48 of housing 40 are located switch aperture 49 and power switch aperture 50 and recess 51. Plunger switch 85 extends out switch aperture 49. Plunger switch 85 is in electrical communication with electronics within housing 40 and indicates when bottom surface 48 of housing 40 is on an object. Power switch 86 extends out of power switch aperture 50 when EAS tag 10 is initially manufactured and assembled. Initially power switch 86 is open and an internal power supply within housing 40 is completely disconnected from the other electronics in the electronics package within housing 40. When EAS tag 10 is to be used for the first time, power switch 86 is moved to a closed state and the power supply is connected to the other electronics. In some embodiments, the power supply is a battery. While power switch 86 is open there is no power drained from the power supply, preserving life of the power supply. In some embodiments, power switch 86 will be used only once. In other embodiments, power switch 86 may be opened any time EAS tag 10 will not be in use. However, in the latter embodiments, if power switch 86 is not moved back to a closed state, EAS tag 10 could be fully installed but fail in its protection purposes since it will be entirely without power.

Both FIGS. 3 and 4 provide a view of plug 22 on end 21 of tether 20. Plug 22 has flange 23, core 24, retention groove 25, and tip 26. When plug 22 is inserted into insert aperture 41 in housing 40, core 24, retention groove 25, and tip 26 protrude into housing 40, while flange 23 abuts the side of housing 40. Plug 22 may take other forms complementary to a particular housing or a particular retention mechanism.

Figure 5:
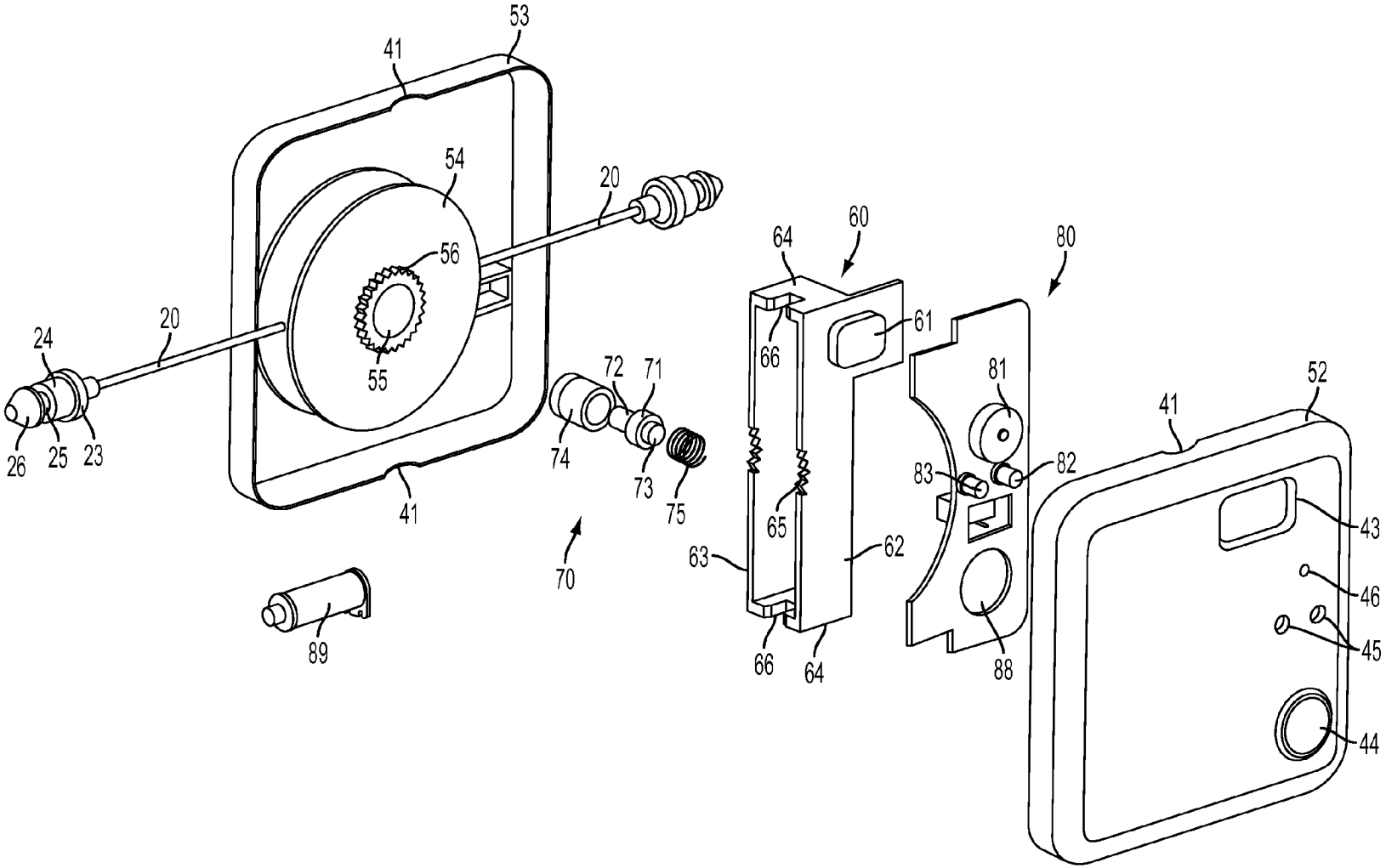
FIG. 5 is an exploded perspective view of the housing of EAS tag with wrapping tethers and cover.

FIG. 5 is an exploded perspective view of housing 40 of EAS tag 10 with wrapping tethers 20 and cover 30. Housing 40 is separated into top portion 52 and bottom portion 53 and elements of EAS tag 10 contained in the interior of housing 40 are visible. Tether reel 54 is located in bottom portion 53. Tethers 20 are wound up in tether reel 54, and tether reel 54 is spring loaded to maintain tension in tethers 20 when EAS tag 10 is installed and to retract tethers 20 when tethers 20 are not connected to another EAS tag. In the embodiment shown in FIG. 5, tethers 20 are electrically conductive and tether reel 54 provides electrical contact for the ends of tethers 20 retained within tether reel 54. A surface on plug 22 provides the electrical contact at the exposed ends of tethers 20. Tether reel 54 has hub 55 at its central axis. Hub 55 has ratchet teeth 56 around its perimeter and turns whenever tethers 20 are extended or retracted from tether reel 54.

In proximity to tether reel 54 within housing 40 is slide 60. Slide 60 has a top rail 62 and a bottom rail 63. Top rail 62 and bottom rail 63 are joined to each other at their ends by ends 64. Button 61 rises from top rail 62. Slide 61 is capable of moving back and forth within housing 40, and, in the embodiment shown in FIG. 5, requires manual operation between two positions. Other embodiments may employ retention mechanisms which automatically engage ends 21 of tethers 20 when ends 21 are inserted in insert apertures 41. On their edges that face hub 55, top rail 62 and bottom rail 63 have teeth 65 which match ratchet teeth 56 on hub 55. When slide 60 is moved into contact with hub 56, teeth 65 on slide 60 engage ratchet teeth 56 on hub 55 and prevent tether reel 54 from turning. Slide 60 is oriented so that ends 64 on slide 60 are in close proximity to the internal surfaces of the sides of housing 40 that have insert apertures 41 through them. Ends 64 have notches 66 facing toward the center of housing 40 and when slide 60 is moved to the center of housing 40, notches 66 align with insert apertures 41 in housing 40. If a plug 22 of a tether 20 is in insert aperture 31 at the time slide 60 is moved to the center of housing 40, notches 66 in ends 64 of slide 60 will engage retention groove 25 in plug 22.

Once slide 60 is moved to engage hub 55 and retain tethers 20, a mechanism is needed to maintain slide 60 in position. Referring still to FIG. 5, when slide 60 is moved to engage tethers 20 and hub 55, blocker 70 shifts to a blocking position to maintain slide 60 in the engaged position. Blocker 70 is has a central rim 71 with a seat pin 72 extending from its bottom side and a spring pin 73 extending from its top side. Cup 74 is located in bottom portion 53 of housing 40, receives seat pin 72 of blocker 70, and maintains blocker 70 in position. Spring 75 rests on central rim 71 of blocker 70 with spring pin 73 partially inserted into spring 75, maintaining spring 75 in position on central rim 71. When housing 40 is assembled, the end of spring 75 that is opposite to central rim 71 presses on the underside of release dome 44 of top portion 52. This biases blocker 70 down into cup 74. At least some portion of blocker 70 is magnetically attractable. When a magnet is applied to release dome 44, blocker 70 is moved upward, changing the position of central rim 71. When central rim 71 is moved upward, this gives slide 60 room to move away from center of housing 40 and top rail 62 moves under central rim 71. When slide 60 is moved to the center of housing 40, blocker 70 moves downward, and central rim 71 moves into position behind top rail 62. Central rim 71 prevents slide 60 from moving away from center until a magnet is applied to release dome 44 to shift blocker 70 upward.

Housing 40 encloses an electronics package with several electronic components for electronic article surveillance functions. Circuit board 80 within housing 40 carries the electronic components. Sound generator 81, light emitting diode (LED) 82, and optical communication port 83 mount to the top surface of circuit board 80. When housing 40 is assembled, sound generator aligns with auditory aperture 46 while LED 82 and optical communication port 83 align with optical apertures 45. Other electronic components are mounted on the bottom of circuit board 80. Microprocessor 84, plunger switch 85, power switch 86, and a power supply, battery 87, mount to the bottom of circuit board 80. Circuit board 80 may have electrical contacts which maintain electrical continuity with slide 60. Other embodiments may employ fixed contacts in housing 40 to provide electrical continuity between the electronics package and the ends 21 of tethers 20. Circuit board 80 has clearance aperture 88 through it which allows blocker 70 to span from top portion 52 to bottom portion 53 of housing 40.

In some embodiments of EAS tag with wrapping tethers and cover 10, housing 40 may enclose passive element 89. In EAS systems using passive elements, an interrogation field is created at control locations, such as exits, by transmitting antennas. The transmitting antennas intermittently create a field in their near surroundings. This field and passive EAS element 89 are tuned to each other. If a housing 40 having a passive element 89 within it is brought into an interrogation field, passive element 89 is energized by the interrogation field and produces a signal detectable by the broader EAS system such as by receiver antennas or transceiver antennas. While passive element 89 in FIG. 5 visually resembles a ferrite core and coil passive element other types of passive elements, such as acousto-magnetic elements, may be used as well.

Figure 6:
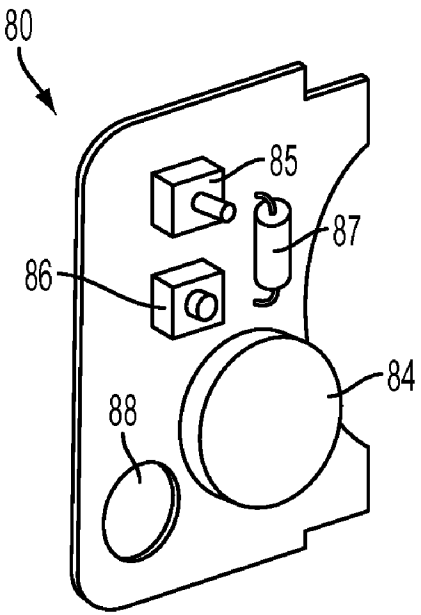
FIG. 6 is a perspective view of the reverse side of the circuit board shown in FIG. 5.

FIG. 6 is a perspective view of the reverse side of the circuit board shown in FIG. 5. Several additional electronic components may be seen on this side of circuit board 80. In this embodiment, microprocessor 84, plunger switch 85, power switch 86, and battery 87 are located on this side of circuit board 84.

Figure 7:
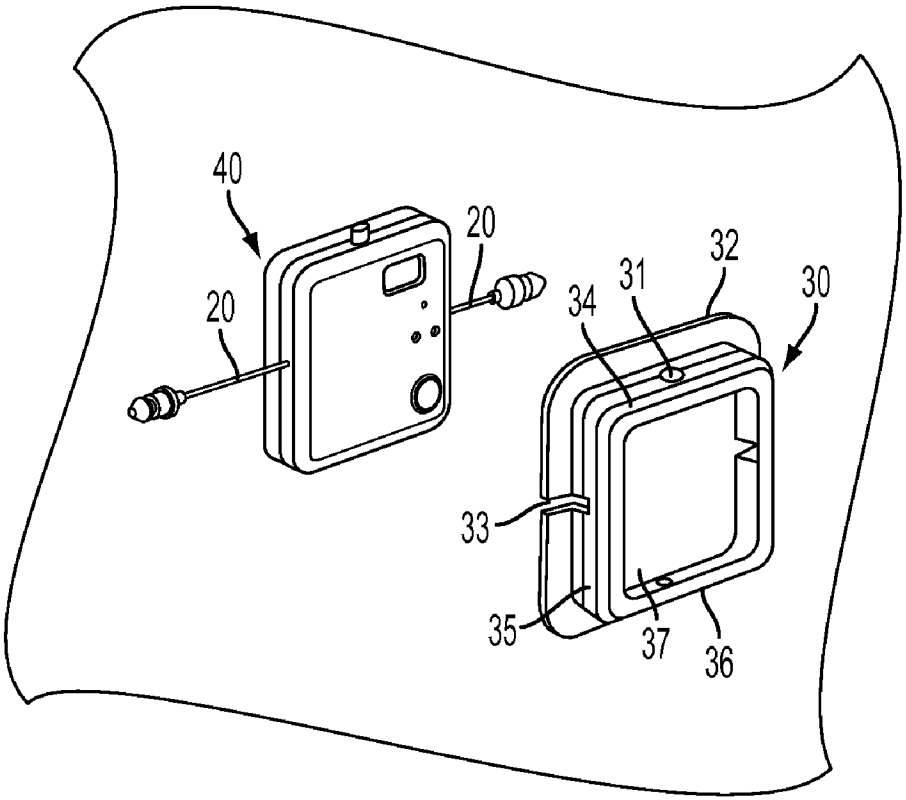
FIG. 7 shows an EAS tag with wrapping tethers and cover in the process of installation on an object to be protected.

FIG. 7 shows an EAS tag 10 with wrapping tethers 20 and cover 30 in the process of installation on an object to be protected. Housing 40 with tethers 20 extending from it is shown on the surface of the object with cover 30 in proximity. Cover 30 is generally formed to have the same perimeter and height as housing 40 with some additional size to fit over housing 40. Flange 32 runs around the perimeter of cover 30 and provides a surface for adhesive attachment to an object. Cover 30 has insert apertures 31 in two opposite sides 34 and tether slots 33 in the other two opposite sides 35. Tether slots 33 extend through flange 32 to accommodate tethers 20 so that cover 30 can be placed over housing 40. Cover 30 has an access aperture 37 in top surface 36. In the embodiment shown in FIG. 7, access aperture 37 takes up nearly the entirety of top surface 36 of cover 30. This gives cover 30 the appearance somewhat of a frame or hoop. Other embodiments of cover 30 may employ a smaller access aperture or multiple smaller access apertures.

To use the EAS tag 10 with tethers 20 and cover 30, a set of two is required. If it is the first time that a given housing 40 is to be used, power switch 86 on the bottom surface 48 of housing 40 is depressed. This connects the internal power supply, battery 87, to the rest of the electronics package within housing 40. Housing 40 of a first EAS tag 10 is then placed in a cover 30 with its tethers 20 extending through tether slots 33. The bottom of flange 32 on cover 30 has an adhesive 38 on it and cover 30 with housing 40 inside is mounted onto the side of a box 100 or other item to be protected, or monitored. When housing 40 contacts the box, plunger switch 85 on bottom surface 48 is depressed which changes it state. This is an input into the electronics of EAS tag 10.

The procedure is repeated with a second EAS tag 10, taking care to orient it appropriately with the first EAS tag 10. The tethers 20 from each housing 40 are extended around the box 100 and inserted into insert apertures 41. Slide buttons 61 are then slid to move slides 60 and engage the notches 66 in ends 64 of slides 60 with retention grooves 25 in plugs 22 on the ends 21 of tethers 20. Slides 60 retain tethers 20 in housings 40. Tethers 20 are constructed such that they can conduct electricity. Slides 60 may be constructed such that they can conduct electricity to provide electrical continuity between ends 21 of tethers 20 and circuit board 80 within housing 40. When ends 64 of slide 60 engage plugs 22, a circuit is completed between the two EAS tags 10. Alternatively, static contacts within housing 40 may provide electrical continuity between ends 21 of tethers 20 and circuit board 80 within housing 40.

Figure 8:
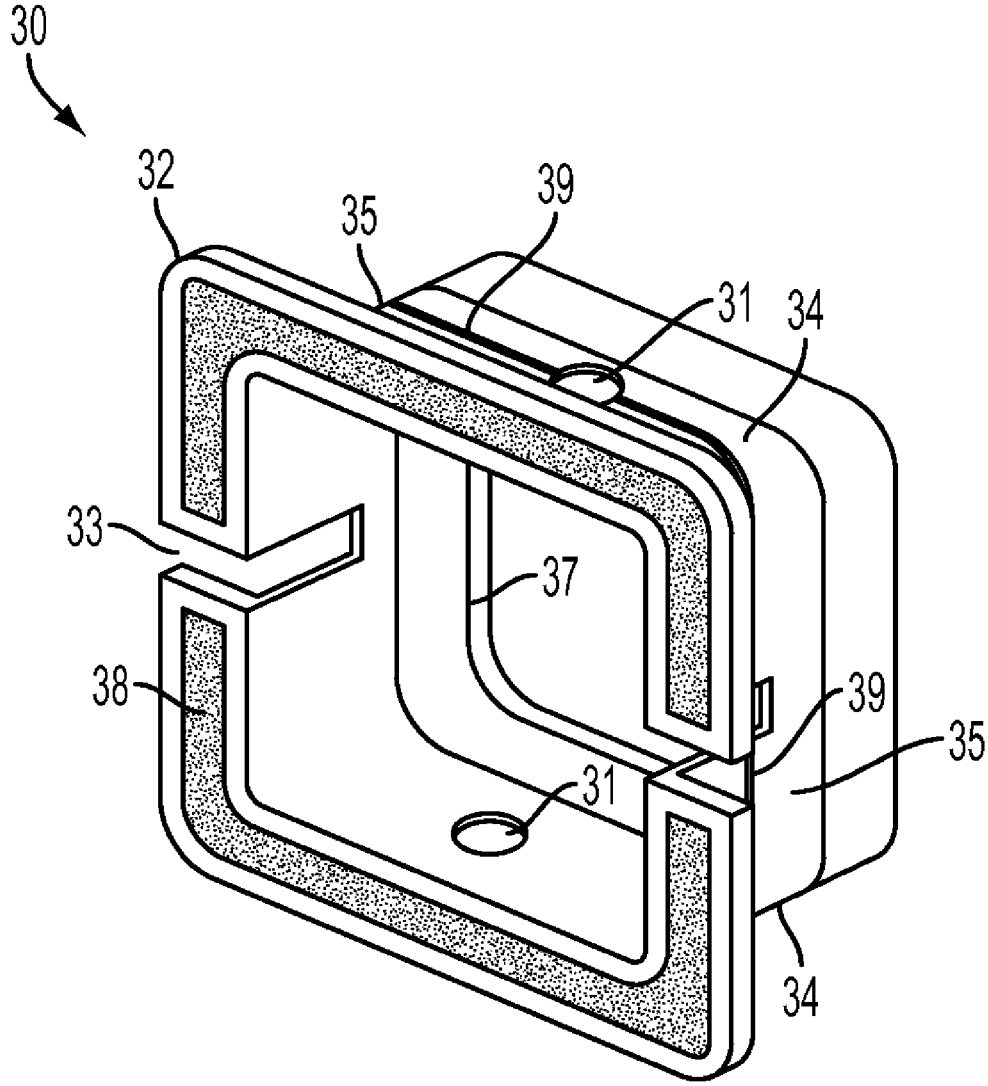
FIG. 8 is a bottom perspective view of a cover.

FIG. 8 is a bottom perspective view of cover 30. Cover 30 is sized and shaped to fit over housing 40. Cover 30 has insert apertures 31 on opposite sides 34 to allow insertion of tethers 20 in housing 40. On the other opposite set of sides 35, cover 30 has tether slots 33 through flange 32 and up into sides 35. Tether slots 33 accommodate tethers 20, so that housing 40 may be placed in cover 30. Access aperture 37 in the top of cover 30 provides access to top surface 42 of housing 40. In FIG. 8, adhesive 38 is shown as an adhesive pad, whereas in FIG. 2, adhesive 38 is shown as an adhesive applied to flange 32 in fluid or semi-fluid form. In the embodiment of cover 30 shown in FIG. 8, around the sides 34 and 35 of cover 30 runs score 39. Score 39 is positioned on sides 35 to intersect tether slots 33 and facilitates the separation of cover 30 into two parts. By intersecting tether slots 33, score 39 causes tether slots 33 to be opened at their sections on sides 35, when cover 30 is partitioned at score 39. This allows housing 40 to be easily removed from cover 30. Other embodiments of cover 30 may require that housing 40 be freed from cover 30 by parting cover 30 without facilitation of score 39 or by removing cover 30 by overcoming adhesive 38.

Figure 9:
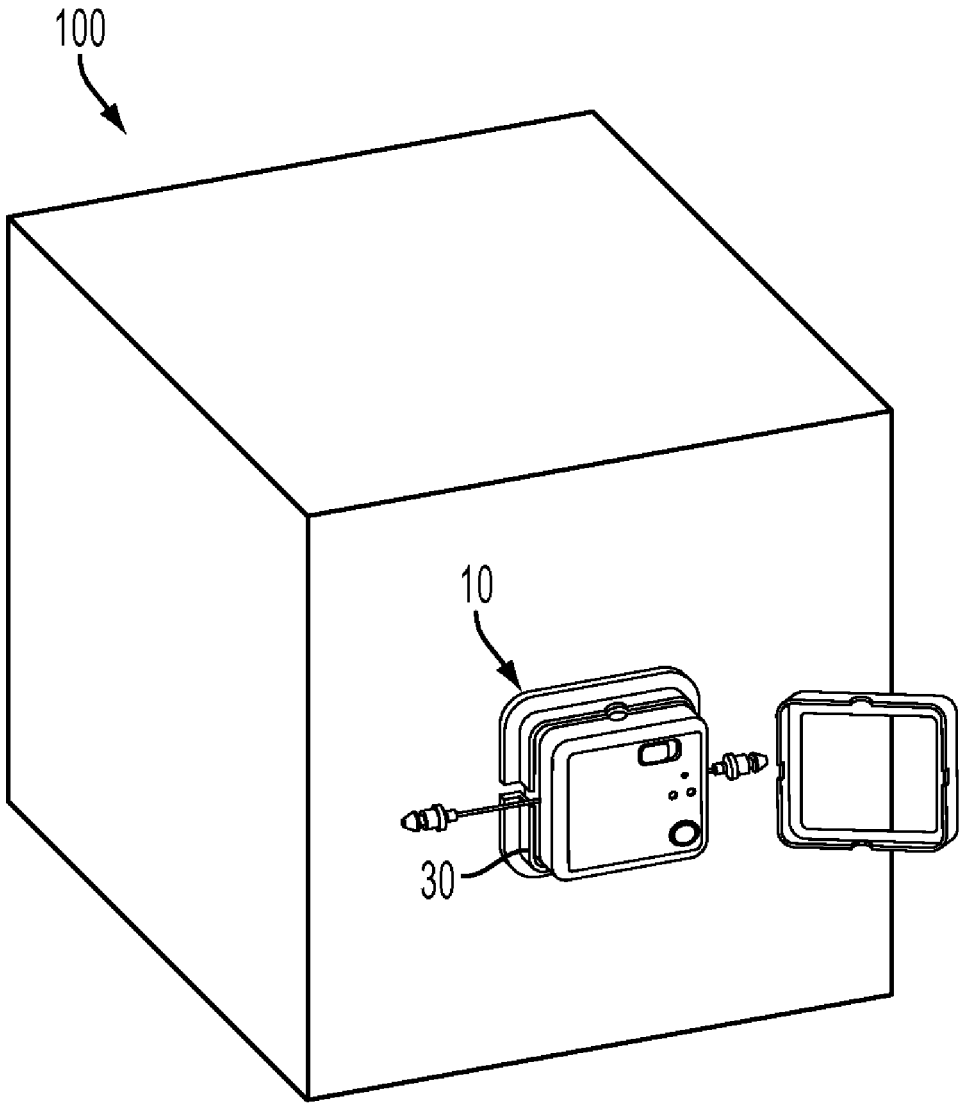
FIG. 9 is a perspective view with the top portion of the cover removed to allow removal of the housing with tethers.

FIG. 9 is a perspective view with the top portion of cover 30 removed to allow removal of housing 40 with tethers 20. Removal of the top portion of housing 30 opens tether slots 33 to allow tethers 20 to be extracted from tether slots 33 without pulling tethers 20 through slots 33. As noted above, other embodiments of cover 30 may require that housing 40 be freed from cover 30 by parting cover 30 without facilitation of score 39 or may require complete removal of cover 30 from the object to be protected by overcoming adhesive 38. Some embodiments may only require cover 30 to be parted enough to allow removal of housing 40 from cover 30 by pulling tethers 20 through slots 33 as housing 40 is removed.

In use, at least two EAS tags 10 are used together. If it is the first time a given housing 40 with tethers 20 is used, power switch 86 on the bottom surface 48 of housing 40 is depressed to complete the power circuit within housing 40. This connects the power, supply, battery 87, into the electronic circuitry of housing 40. Once power switch 86 is depressed, housing 40 with tethers 20 extending from it is placed in cover 30 to assemble the first of the EAS tag components. Flange 32 on cover 30 has adhesive 38 on its bottom surface. Adhesive 38 may be applied by the user or adhesive 38 may be applied at the time that cover 30 is manufactured. Cover 30 with housing 40 inside is pressed onto an object to be protected. Tethers 20 of this first EAS tag assembly 10 are pointed in a first orientation.

On bottom surface 48 of housing 40 of the first assembly is located plunger switch 85. When the first EAS Tag assembly 10 is pressed onto an object to be protected, plunger switch 85 is depressed and this changes the state of plunger switch 85. This is an input signal to the electronics within housing 40. This input is interpreted by the electronics within housing 40 as an indication that the assembly has been placed on an object to be protected. Combined with other inputs, this eventually leads to an armed and installed state for the EAS tag system.

A second housing 40 is placed in a cover 30 with tethers 20 extending through tether slots 33 in cover 30. If power switch 86 on housing 40 has not been depressed on this second housing 40, power switch 86 is depressed to provide power from battery 87 to the electronics within housing 40. Flange 32 on cover 30 of this second assembly also has adhesive 38 on its bottom surface. Cover 30 with housing 40 inside is pressed onto the object to be protected with its tethers 20 pointed in a second orientation. Generally the first orientation of tethers 20 in the first assembly will be perpendicular to the second orientation of the tethers 20 of the second assembly.

The tethers 20 of the first assembly are pulled and extended from housing 40 of the first assembly and wrapped around the object to be protected, and plugs 22 at the end 21 of tethers 20 are inserted through insert aperture 31 of cover 30 and insert aperture 41 of housing 40. Tethers 20 of the second assembly of EAS Tag 10 are pulled and extended from housing 40 of the second assembly and wrapped around the object to be protected and plugs 22 at the ends 21 of tethers 20 are inserted into insert apertures 31 of cover 30 and insert apertures of 41 of housing 40 of the first assembly.

Once tethers 20 are extended and plugs 22 are inserted into apertures 41 of housings 40, slide button 61 on top surface 42 of housing 40 in the first assembly is slid. This moves slide 60 towards the center of housing 40 and notches 66 in ends 64 of slide 60 engage retention grooves 25 in plugs 22 to retain tethers 20. When ends 21 of tethers 20 from the second assembly are installed in housing 40, a circuit is completed between the first housing 40 and second housing 40 through tethers 20. Slide 60 may provide an electrical connection between tethers 20 and circuit board 80 or static contacts within housing 40 may provide that connection. Additionally, when slide 60 is slid, teeth 65 on rails 62 and 63 engage ratchet teeth 56 on hub 55. This prevents tether reel 54 from turning. Slide button 61 on top surface 42 of second housing 40 is then slid to engage notches 66 on ends 64 of slide 60 with retention grooves 25 on plugs 22. Installation of ends 21 of tethers 20 from the first housing 40 into the second housing 40 creates a second circuit through tethers 20 of the first assembly. Again teeth 65 on rails 62 and 63 engage ratchet teeth 56 on hub 55 to prevent tether reel 54 from turning.

When slide 60 in each of housings 40 are slid toward the center of housing 40 blocker 70 moves into position behind slide 60 to prevent its return. Blockers 70 comprises a central rim with a seat pin 72 extending from the bottom of central rim 71 and a spring pin 73 extending from the top of the central rim 71. Seat pin 72 inserts into cup 74 which maintains blocker 70 in its location within housing 40. Spring pin 73 extends upward into spring 75 which contacts the bottom interior surface of release dome 44 of top portion 52 of housing 40 and biases blocker 70 downward. When slide 60 is moved toward the center of housing 40, blocker 70 is released to move downward and central rim 71 on blocker 70 moves in behind top rail 62 of slide 60 to prevent slide 60 from moving away from the center of housing 40. Blocker 70 is at least partially made of a magnetically attractable material. Application of a magnet to release dome 44 pulls blocker 70 upward, moving central rim 71 from behind top rail 62 of slide 60. This allows slide 60 to be moved from its center location in housing 40. When slide 60 is moved from its center position, top rail 62 moves under central rim 71, which holds blocker 70 in a retracted position.

Once both assemblies are mounted on an object to be protected and their tethers connected and engaged to each other, several conditions have been met. Plunger switches 85 on the bottom of each housing 40 have had their state changed, while circuits between the two housings have been established. Microprocessor 84 mounted on circuit board 80 has executable instructions stored on it which provide the logic for recognizing the state change in plunger switches 85 and the completion of the circuits including tethers 20. Microprocessor 84 can communicate with external devices via wireless communication such as optical links or radio frequency transmission. In some embodiments the completion of the second circuit will suffice to arm the devices. In other embodiments, an additional step may be taken by arming the devices with an external device which communicates with microprocessor 84. This external device may be a hand held wireless communicator such as is shown in FIG. 1. This wireless communication device may communicate with optical signals such as infra red communication signals or it may communicate with radio frequency signals.

Once EAS tags 10 are installed and armed, if the circuits from tethers 20 are broken, or if the plunger switches 86 on the bottom surfaces 48 have their states changed without the tags being disarmed, microprocessor 84 will instruct sound generator 81 within housings 40 to generate an audible alarm signal. Microprocessor 84 may also instruct the communication elements in the onboard electronics to communicate an alarm signal to external devices. The circuits created by tethers 20 may be interrupted by forcibly removing plugs 22 from housing 40, by cutting tethers 20, or by applying a magnet to release dome 44. Plunger switches 85 may have their states changed by forcibly removing EAS tags 10 from the object being protected.

After EAS tags 10 are armed, whether or not an external device was used to complete the arming, an external device is needed to disarm the EAS tags 10 installed and assembled on an object to avoid an alarm condition and subsequent generation of an alarm. As previously mentioned, an external device can communicate with microprocessor 84 via wireless communication. Once EAS tags 10 are disarmed, a magnet may be applied to release dome 44 to shift blocker 70 to the retention mechanism, slide 60, to be moved back from engagement with plugs 22 and hub 55. This allows tethers 20 to be removed from insert apertures 41 of housing 40. This is repeated for both housings 40.

Once tethers 20 are decoupled from housings 40, housings 40 can be removed from the object being protected. This can be accomplished in several ways. Adhesive 38 on the bottom of flange 32 of a cover 30 may be overcome and cover 30 may be removed in its entirety, allowing housing 40 to be removed through the bottom of cover 30 with tethers 20 passing out slots 33 in flange 32. Alternatively, cover 30 may be partitioned so that housing 40 may be removed without separating flange 32 of cover 30 from the object to be protected. If the partition of cover 30 opens up slots 33 in sides 35 of cover 30, housing 40 may be removed without pulling tethers 20 through slots 33. If the partition of cover 30 does not open up slots 33 in sides 35 of cover 30, tethers 20 have to be pulled through slots 33 as housing 40 is removed from cover 30.

Some embodiments of cover 30 may have at least one score in cover 30 to facilitate the partitioning of cover 30.

In some applications, both housings 40 may have a full set of electronics in their electronics packages, while in other applications, a primary EAS tag and secondary EAS tag will be used. The primary EAS tag will have the full set of electronics in its interior. The secondary EAS tag will not have a full set of electronics and may only have enough to complete the circuits formed by tethers 20. In the latter case, the electrical circuit would travel from circuit board 80 in the primary EAS tag through tethers 20 of the primary EAS tag out to the secondary EAS tag and back through the tethers 20 of the secondary EAS tag to the circuit board 80 of the primary EAS tag. In the simplest case, the retention mechanism, or other contacts in the secondary EAS tag, would complete the circuit at that end.

In the embodiments shown in FIGS. 1, 2, 7, and 8, cover 30 has a single large aperture 37 providing access to top surface 42 of housing 40. This is best seen in FIGS. 7 and 8. Other embodiments of cover 30 may employ smaller apertures giving more selective access to features on top surface 42 of housing 40 such as slide button 61, release dome 44, optical apertures 45, and auditory aperture 46.

It is to be understood that the embodiments and claims are not limited in application to the details of construction and arrangement of the components set forth in the description and illustrated in the drawings. Rather, the description and the drawings provide examples of the embodiments envisioned, but the claims are not limited to any particular embodiment or a preferred embodiment disclosed and/or identified in the specification. The drawing figures are for illustrative purposes only, and merely provide practical examples of the invention disclosed herein. Therefore, the drawing figures should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations. Accordingly, those skilled in the art will appreciated that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

I claim:

1. A security apparatus comprising:

a first housing enclosing a first interior, said first housing having a top panel, a bottom panel and at least one side connecting said top and bottom panel, said first housing having a first set of tethers having at least one tether, each tether extending from said first interior and having an end, said first housing having a tether aperture for each tether and also having at least one insert aperture for receiving the end of a tether, said first housing having a retention mechanism proximal to each of said insert apertures for retention of the end of a tether inserted into said insert apertures;

a first cover shaped to receive said first housing, said first cover having a top panel, a bottom panel, and at least one side connecting said top and bottom panel of said first cover, said at least one side of said first cover providing sufficient depth to accommodate said first housing, said first cover having at least one insertion aperture for each said insertion aperture in said first housing and at least one tether aperture for each said tether aperture in said first housing, said bottom panel of said first cover having an aperture for receiving said first housing and a bottom surface opposite said top panel of said first cover for receiving adhesive;

a second housing enclosing a second interior, said second housing having a top panel, a bottom panel and at least one side connecting said top and bottom panel, said second housing having a second set of tethers having at least one tether, each tether extending from said second interior and having an end, said second housing having a tether aperture for each tether and also having at least one insert aperture for receiving the end of a tether, said second housing having a retention mechanism proximal to each of said insert apertures for retention of the end of a tether inserted into said insert apertures;

a second cover shaped to receive said second housing, said second cover having a top panel, a bottom panel, and at least one side connecting said top and bottom panel of said second cover, said at least one side of said second cover providing sufficient depth to accommodate said second housing, said second cover having at least one insertion aperture for each said insertion aperture in said second housing and at least one tether aperture for each said tether aperture in said second housing, said bottom panel of said second cover having an aperture for receiving said second housing and a bottom surface opposite said top panel of said second cover for receiving adhesive.

2. The security apparatus of claim 1 further comprising:

a first electronic package within said first interior.

3. The security apparatus of claim 2, wherein:

said first electronic package comprises a passive electronic article surveillance element.

4. The security apparatus of claim 2, wherein:

said bottom panel of said first housing comprises a plunger switch aperture; and said first electronic package comprises an on-board power supply, a plunger switch extending through said plunger switch aperture, and a sound generator.

5. The security apparatus of claim 4, wherein:

said first housing comprises a power switch aperture; and said first electronic package further comprises a power switch extending through said power switch aperture.

6. The security apparatus of claim 4, wherein:

said first electronic package further comprises a microprocessor, circuit board, and wireless communication elements.

7. The security apparatus of claim 6, wherein:

said wireless communication elements comprise an infrared communication port.

8. The security apparatus of claim 6, wherein:

said wireless communication elements comprise radio communication circuitry and antenna.

9. The security apparatus of claim 6, wherein:

said first set of tethers comprises at least two tethers, said tethers being electrically conductive and in electrical continuity with said first electronic package;

said second housing having at least one insert aperture for receiving each tether in said first set of tethers, said ends of said at least two tethers from said first set being in electrical continuity with each other when said ends are inserted in said insert apertures of said second housing and retained by said retention mechanism proximal to each of said insert apertures in said second housing.

10. The security apparatus of claim 9, wherein:

said second set of tethers comprises at least two tethers, said tethers being electrically conductive and in electrical continuity with said first set of tethers when said ends of said first set are inserted in said insert apertures of said second housing and retained by said retention mechanism proximal to each of said insert apertures in said second housing;

said first housing having at least two insert apertures for receiving said at least two tethers from said second housing, said ends of said at least two tethers from said second housing being in electrical continuity with said first electronic package when said ends of said second set of tethers are inserted in said insert apertures of said first housing and retained by said retention mechanism proximal to each of said insert apertures in said first housing.

11. The security apparatus of claim 10 further comprising:

a second electronic package within said second interior.

12. The security apparatus of claim 11, wherein:

said second electronic package comprises a passive electronic article surveillance element.

13. The security apparatus of claim 12, wherein:

said bottom panel of said second housing comprises a plunger switch aperture; and said second electronic package comprises an on-board power supply, a plunger switch extending through said plunger switch aperture, and a sound generator.

14. The security apparatus of claim 13, wherein:

said second housing comprises a power switch aperture; and said second electronic package further comprises a power switch extending through said power switch aperture.

15. The security apparatus of claim 13, wherein:

said second electronic package further comprises a microprocessor, circuit board, and wireless communication elements.

16. The security apparatus of claim 15, wherein:

said wireless communication elements comprise an infrared communication port.

17. The security apparatus of claim 15, wherein:

said wireless communication elements comprise radio communication circuitry and antenna.

18. The security apparatus of claim 1, wherein:

said first set of tethers is at least partially retractable into said first housing; and said second set of tethers is at least partially retractable into said second housing.

19. The security apparatus of claim 1, wherein:

said retention mechanisms are manually operable.

20. The security apparatus of claim 1, wherein:

said retention mechanisms are releasable.

21. The security apparatus of claim 20, wherein:

said retention mechanisms are releasable by application of a magnet to said housings.

22. The security apparatus of claim 1, wherein:

said first cover has an aperture in said top panel for access to at least part of said top panel of said first housing; and said second cover has an aperture in said top panel for access to at least part of said top panel of said second housing.

23. The security apparatus of claim 1, wherein:

said first cover has at least one score in it to facilitate parting said first cover; and said second cover has least one score in it to facilitate parting said second cover.

* * * * *